US008613126B2

(12) United States Patent
Blockley

(10) Patent No.: US 8,613,126 B2
(45) Date of Patent: Dec. 24, 2013

(54) HYDRAULIC DOOR CLOSURE APPARATUS WITH BOOST

(76) Inventor: William Edward Blockley, Bakersfield, CA (US)

( * ) Notice: Subject to any disclaimer, the term of this patent is extended or adjusted under 35 U.S.C. 154(b) by 175 days.

(21) Appl. No.: 13/268,005

(22) Filed: Oct. 7, 2011

(65) Prior Publication Data

US 2013/0086771 A1 Apr. 11, 2013

(51) Int. Cl.
*E05F 1/00* (2006.01)

(52) U.S. Cl.
USPC ..... 16/71; 16/51; 16/52; 16/56

(58) Field of Classification Search
USPC ..... 16/51–52, 54, 56, 58, 62, 64, 79, 85, 16/DIG. 9, DIG. 10, 71; 188/290, 295, 188/313–315, 322.5
See application file for complete search history.

(56) References Cited

U.S. PATENT DOCUMENTS

| | | | | |
|---|---|---|---|---|
| 4,263,694 | A * | 4/1981 | Jentsch | 16/48.5 |
| 4,378,612 | A * | 4/1983 | Beers | 16/62 |
| 4,660,250 | A * | 4/1987 | Tillman et al. | 16/58 |
| 4,744,125 | A | 5/1988 | Scheck et al. | |
| 4,928,799 | A | 5/1990 | Zschiesche | |
| 4,937,913 | A * | 7/1990 | Jentsch | 16/58 |
| 4,995,194 | A * | 2/1991 | Schultze et al. | 49/32 |
| 4,999,872 | A * | 3/1991 | Jentsch | 16/58 |
| 5,018,607 | A | 5/1991 | Hardtke | |
| 5,102,109 | A | 4/1992 | Schnetz | |
| 5,187,835 | A * | 2/1993 | Lee | 16/52 |
| 5,259,090 | A * | 11/1993 | Fayngersh | 16/52 |
| 5,414,894 | A * | 5/1995 | Fayngersh | 16/52 |
| 5,850,671 | A * | 12/1998 | Kaser | 16/79 |
| 6,151,753 | A * | 11/2000 | Salutzki | 16/62 |
| 6,863,163 | B2 | 3/2005 | Oliver et al. | |
| 7,971,316 | B2 * | 7/2011 | Copeland et al. | 16/79 |
| 8,415,902 | B2 * | 4/2013 | Burris et al. | 318/3 |

* cited by examiner

*Primary Examiner* — William Miller
(74) *Attorney, Agent, or Firm* — Joseph Golant

(57) ABSTRACT

A door closure apparatus with boost for latching a door to which the apparatus is attached. The door closure includes two pivotal arms, an outer covering and an elongated housing. In the housing are a main piston with a rack to engage a pinion connected to rotate with one of the pivotal arms, a piston rod, a main spring, a divider wall, an adjustable main spring seat, a supplemental piston and a supplemental spring. The housing is filled with hydraulic fluid and is divided into three chambers with ports and passageways to move fluid during door opening, which stores energy in both the main and the supplemental springs, and door closing, which begins with energy from the main spring and latches with a boost of energy from the supplemental spring.

20 Claims, 9 Drawing Sheets

HYDRAULIC DOOR CLOSURE APPARATUS WITH BOOST

FIELD OF THE INVENTION

The present invention relates generally to a door closure apparatus and method, and, more particularly, to a hydraulic door closure apparatus with a closing boost that is structurally robust, compliant with the Americans with Disabilities Act (ADA), effective, relatively simple and inexpensive when compared to powered door closures.

BACKGROUND OF THE INVENTION

Door closure apparatus are in general use in commercial locations throughout the country and have been patented for decades. Unfortunately, the earlier devices disclosed here are often incompatible with ADA requirements.

Door closers and shock absorbers are known in the marketplace and are disclosed in several existing patents. By way of example, Scheck, Storandt and Feucht patented a door closure in 1988, U.S. Pat. No. 4,744,125 for a "Door Closer Transmission Including An Eccentric Pinion" that purports to disclose a device having a housing containing an outer piston and an inner piston, each piston being biased by its own compression spring that compresses with the opening of a door to which the door closer is attached. The outer piston includes a rack that engages a gear mounted to an axle that rotates upon door opening. The inner piston includes an abutment that is engaged by a rotating element also connected to the door-opening axle. Because of different geometries of the rack and the rotating element, the compression of the outer piston spring is linear as a function of the door-opening angle. The inner piston spring has a greater return force at small door angles but less force as the angle of opening increases. In 1998 U.S. Pat. No. 5,850,671 for a "Door Closer" issued to Kaser and purports to disclose an apparatus having a housing filled with hydraulic fluid, a main piston, an auxiliary piston, a rack, a closer shaft with a pinion, two strong compression springs, one weaker compression spring and various fluid passages and valves. When an attached door is opened the pinion and rack move the main piston to compress the strong compression springs and fluid is transferred. The weak spring remains in a compressed condition between the auxiliary piston and the main piston. After the door is opened and the opening force is released, the door quickly closes under the strong biasing force of the two strong compression springs during a first time phase. During a next second phase, the door closes more slowly because fluid is restricted through an overflow duct so that movement of the pistons is due to the weaker compression spring. If the door does close completely during the second phase, fluid again flows more freely and all three springs bias the door closed.

U.S. Pat. No. 4,928,799 for a "Hydraulic Dashpot" issued in 1990 to Zachiesche and purports to disclose a dashpot with an automatic closure when a valve located between the dashpot and a hydraulic storage chamber is removed for inspection. The dashpot includes the usual cylindrical housing, a piston, first and second hydraulic chambers one to each side of the piston, a piston rod and oppositely placed connecting elements, one connected to the housing and the other to the rod. In communication with the hydraulic chambers are the pressurized hydraulic storage chamber, a feed line and two valves. In 1991 U.S. Pat. No. 5,018,607 issued for a "Hydraulic Dashpot For Pipeline Systems" to Hardtke and Bernert and purports to disclose a dashpot having a cylindrical housing, a piston separating front and rear cylinder chambers, a piston rod, and a connecting member affixed to the rod and another member affixed to the housing. A main control valve is provided with helical grooves to ensure that if the main control valve if blocked pressure compensation will occur between the front and rear cylinder chambers.

In 1992, U.S. Pat. No. 5,102,109 issued to Schnetz for a "Hydraulic Shock Absorber" and purports to disclose a shock absorber having a pressure dependent damping and piston stroke dependent damping so as to provide damping independent of the type and intensity of the motion to be damped. The shock absorber includes a piston dividing a high-pressure space from a low-pressure space, a piston rod and a compensatory piston. A relief valve handles damping caused by an increase in pressure. The relief valve includes transfer ducts and spring washers that react to the pressure to close the ducts gradually. This arrangement is useful for small energy, low speed impacts. Damping based the piston stroke is handled by a port through the piston and a stationary pin that progressively plugs the port as the piston moves toward the pin. This arrangement is useful with high energy, high-speed impacts.

In 2005, U.S. Pat. No. 6,863,163, for a "Self Leveling Vehicle Suspension Damper" issued to Oliver, Kruckemeyer, Bishop and Jensen, and purports to disclose a suspension damper capable of adjusting the height of a support vehicle while being concealed within the damper. The damper includes a reservoir tube forming an outer housing and an internal tube with a pressurized gas chamber, and a fluid chamber separated by a slidable gas piston. In the fluid chamber is a fluid piston and rod. The internal tube forms the usual fluid pumping chamber. Between the outer housing and the internal tube is a fluid reservoir. For adjusting height of the connected vehicle the internal tube has a number of holes and in the fluid reservoir between the housing and the internal tube is a moving first partition and a control second partition and a chamber between them. When the piston and rod are moving during a compression stroke pressure differences are created between the holes in the internal tube. This pressure is directed to the second partition and causes fluid to be added in the chamber between the partitions causing the first partition to move the first partition thereby reducing the volume available to pressurized gas. The lower volume increases gas pressure and exerts a on the rod so as to increase the height of the connected vehicle.

SUMMARY OF THE INVENTION

In accordance with the present invention, an advantageous method and apparatus are provided in the form of a hydraulic door closure having two separate energy storage devices for boosting performance. The door closure uses the same hydraulic fluid for door movement damping, for door motion control and for energy transfer. The hydraulic door closure of the present invention is ADA compliant. There is no need to use a more expensive electric door closure with increased installation costs. Features and advantages of the present invention include both a low opening force for the door to which the inventive hydraulic door closure apparatus is attached, as required by the ADA, and a high enough closing force to securely close and latch the door. Currently, hydraulic door closures on the market are unable to provide both of these functions.

Briefly summarized, the invention relates to a door closure for providing a closing boost including an elongated housing having first and second opposite ends and being divided generally into first, second and third fluid chambers, a first piston movably mounted in the housing to move fluid between the first and third chambers, the first piston including a rack for engagement with a pinion to move the first piston is response to the door opening and to enable the door to close, a piston rod and retainer connected to the first piston and movable therewith, a second, cup shaped piston movably mounted in the housing and forming the second chamber, a first spring mounted in the first chamber of the housing and operatively connected to the first piston, a second spring mounted in the third chamber of the housing operatively connected to the second piston, a first fluid passageway between the first chamber and the third chamber, a second fluid passageway between the first chamber and the second chamber and including a check valve, a third fluid passageway between the first and third chambers, and a fourth fluid passageway between the first and second chambers, and wherein upon door opening fluid is transferred from the first chamber to the third chamber through the first fluid passageway and initially through the third fluid passageway and the first spring is compressed, and concluding with fluid being selectively transferring through the second passageway from the first chamber to the second chamber to move the second piston and compress the second spring, and during door closing the first spring extends against the first piston, fluid is transferred from the third chamber to the first chamber through the first passageway and the third passageway, and fluid is selectively transferred from the second chamber to the first chamber through the fourth passageway to boost door closing.

The invention also relates to a method for making the door closure having a closing boost, the steps of the method including mounting a first piston, a piston rod, a second piston, a first spring, a second spring, a divider wall and an adjustable spring seat in an elongated housing having first, second and third chambers for hydraulic fluid, arranging the first piston to operatively engage a rotatable pinion and to compress the first spring and selectively compress the second spring when a door to which the door closure is attached is opened, the first piston located between the first chamber and a first portion of the third chamber, arranging the second piston to compress the second spring, the second piston located between the divider wall and an end of the housing in a second portion of the third chamber, placing a passageway with ports in the first chamber and the first portion of the third fluid chamber such that fluid is enabled to move from the first fluid chamber to the first portion of the third fluid chamber when the first piston is operatively engaged by the pinion, placing a second passageway with ports and a check valve in the divider wall to enable fluid to move from the first chamber to the second chamber to move the second piston and compress the second spring, placing a third passageway with ports in the divider wall and communicating the first chamber with the second chamber, and placing a fourth passageway with ports in the first chamber and the first portion of the second chamber to enable fluid to move from the first portion of the third chamber to the first chamber.

A complete understanding of the present invention, along with objects, advantages, and features thereof, will be gained from a consideration of the present specification which provides a written description of the invention, and of the manner and process of making and using the invention, set forth in such full, clear, concise and exact terms as to enable any person skilled in the art to which it pertains, or with which it is most nearly connected, to make and use the same in compliance with Title 35, U.S.C. §112 (first paragraph). Furthermore, the following description of the preferred embodiments of the invention read in conjunction with the accompanying drawing provided herein represents an example of the invention in compliance with Title 35, U.S.C. §112 (first paragraph), but the invention itself is defined in the Claims section attached hereto.

BRIEF DESCRIPTION OF THE DRAWINGS

For the purpose of facilitating an understanding of the invention, the accompanying drawings and detailed description illustrate preferred embodiments thereof, from which the invention, its structures, its construction and operation, its processes, and many related advantages may be readily understood and appreciated.

DESCRIPTION OF THE PREFERRED EMBODIMENTS

Figure 1:
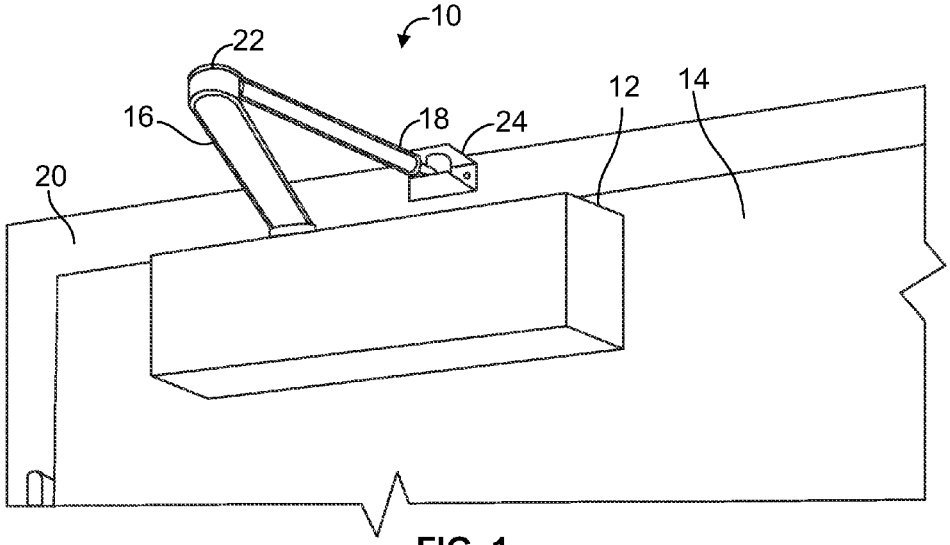
FIG. 1 is an isometric view of a preferred embodiment of the present invention in the form of a hydraulic door closure apparatus mounted to a door and a doorframe.

While the present invention is open to various modifications and alternative constructions, the preferred embodiments illustrating the best mode contemplated by the inventor for carrying out his invention are shown in the various figures of the drawing and will be described herein in detail, pursuant to Title 35 U.S.C. §112 (first paragraph). It is noted, however, that there is no intention to limit the invention to the particular embodiments disclosed herein. To the contrary, the intention is to cover and claim all modifications, equivalent structures and methods, and alternative constructions falling within the spirit and scope of the invention as expressed in the appended Claims section attached hereto, pursuant to Title 35 U.S.C. §112 (second paragraph).

Figure 2:
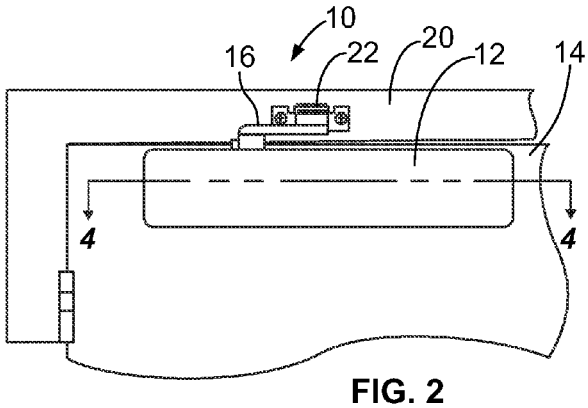
FIG. 2 is a front elevation view of the door closure apparatus shown in FIG. 1.
Figure 3:
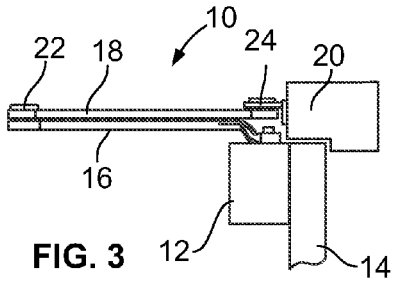
FIG. 3 is a right side elevation view of the door closure apparatus shown in FIGS. 1 and 2.

The present invention has several uses, one of which is in the form of a door closer 10, FIGS. 1-3. When used as a door closer several considerations need to be addressed including the length of a door-opening arc, whether the opening force is normal or high, and at what speed or velocity is the door to be closed and latched. These considerations are partially addressed by the requirements in the Americans with Disabilities Act and ANSI standard A117.1. In many situations doors are opened from about 70° to about 120°. Some doors are exposed to medium opening forces, such as an interior office door, some to excessive forces, such as a door in a high school with rambunctious teenagers, or at locations where outside doors are exposed to prevalent high wind forces. Closing may be slower (more than three seconds) during a "sweep range" from about 70° open to about 10° open (about three inches between door and frame), but faster and more forceful during a "latch range" from about 10° to fully closed. Typically a control valve or screw allows adjustment of door speed from full open to about 10° from full closed and is often called a sweep speed adjustment screw. Another control valve or screw allows adjustment from about 10° to full closed and is often called a latch speed adjustment screw. The benefits offered by the present invention are that both a low opening force is permissible and a high enough closing force is accomplished in a hydraulic door closure apparatus that complies with the ADA.

The door closer apparatus 10 includes an outer casing 12 covering a housing and internal elements described below, attached to a door 14, a main arm 16 pivotally attached to a spindle and to a secondary arm 18 that is pivotally attached to a doorframe 20. The arms 16, 18 are pivotally connected together at a joint 22. The secondary arm 18 is pivotally connected to the doorframe 20 at a joint 24. The main arm 16 is pivotally connected to a spindle in the door closer as shown. Besides the arrangement between the arms and casing illustrated in FIGS. 1-3, the arms may be configured to be nearly parallel to the door, or the casing may be attached to the frame and one of the arms may be attached to the door, or the arms may be part of a slide track. These are all alternative arrangements that will all work with the present invention.

Figure 4:
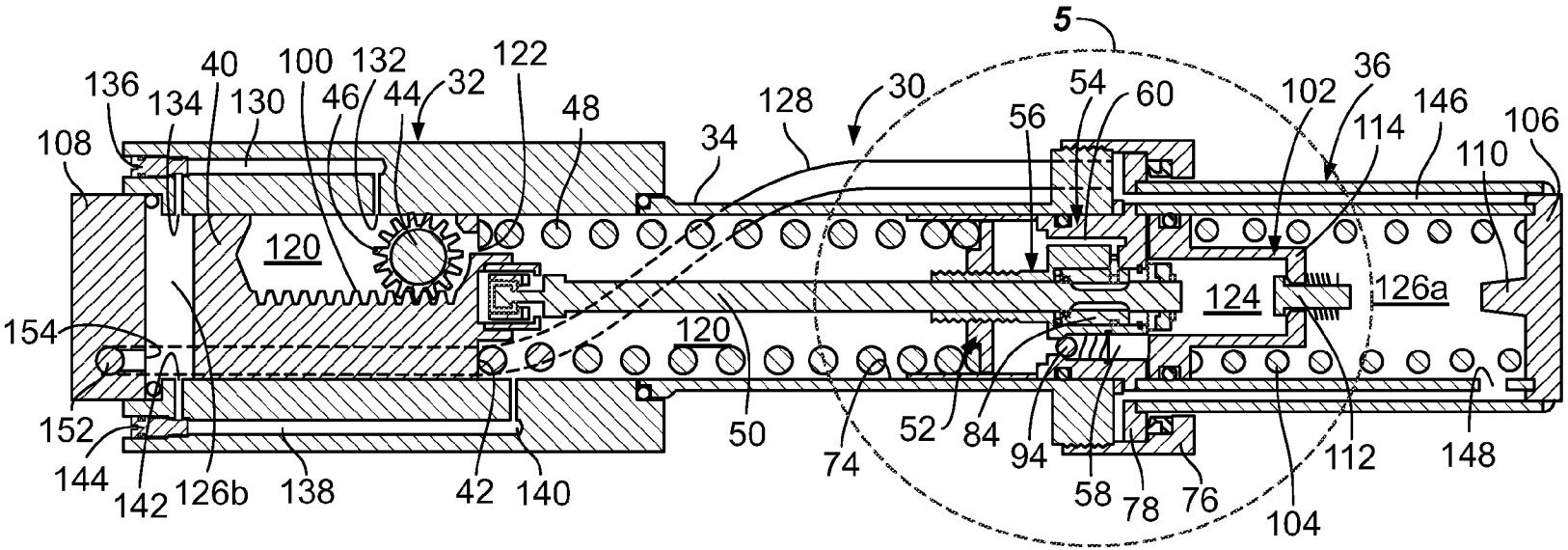
FIG. 4 is a sectional plan view of the door closure apparatus taken along line 4-4 in FIG. 2, illustrating the apparatus at rest.

The door closer also includes an elongated housing 30, FIG. 4, covered by the outer casing 12 in FIGS. 1-3, which is roughly divided into three sections, a first section 32, located to the left as viewed in FIG. 4, a second middle section 34, and a third section 36, located to the right. All three sections of the housing are filled with hydraulic fluid of the type well known to those skilled in the art. Mounted in the first section 32 of the housing 30 is a movable first or main piston 40 having a right side end surface 42, a rotatable spindle 44, a pinion 46 mounted to and rotatable with the spindle 44, a portion of a compressible first or main spring 48 and a portion of a slidable rod 50 joined to the main piston such that the rod is movable with the main piston. The rod 50 and the main spring 48 also extend into the middle section 34 of the housing. Mounted in the middle section 34 are an adjustable spring seat 52, FIGS. 4 and 5, for the main spring 48 and a divider wall 54 between the second and third housing sections 34, 36. The divider wall 54 supports the rod 50 along a sleeve portion 56 and includes a wide fluid passageway 58 and a narrow fluid passageway 60 in a body portion 62. The spring seat 52 is threaded to an outer surface 64 of the divider wall sleeve portion 56 to accommodate longitudinal adjustment for extending or contracting the main spring 48. The spring seat 52 includes notches in its periphery, such as the opposing notches 66, 68, to allow the passage of fluid during operation. To prevent rotation of the spring seat the two opposing notches align with two opposing ridges 70, 72 on the interior wall 74 of the housing 30. An opposite spring seat for the main spring is formed on the right side end surface 42 of the main piston 40.

Figure 5:
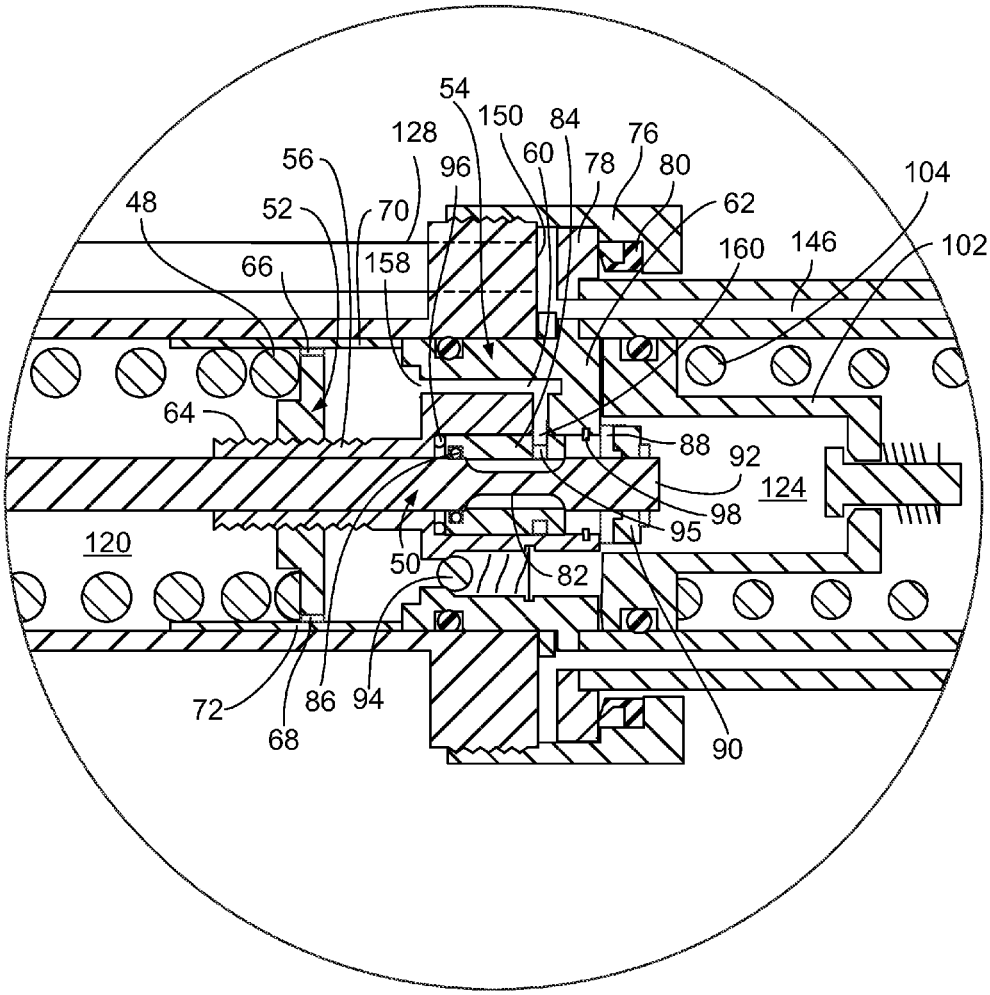
FIG. 5 is an enlarged view taken within circle 5-5 in FIG. 4.

The right housing section 36 is mounted to rotate with the divider wall 54, FIGS. 4 and 5, to adjust the main spring seat 52. The center and right housing sections 34, 36 are connected by a threaded outer ring 76 that is threaded to the middle section 34 and abuts a flange 78 of the right section 36. A seal 80 in the ring 76 is provided to prevent fluid leakage. Mounted between the divider wall 54 and a double grooved portion 82 of the rod 50, in a lateral direction, is a sleeve valve 84 movable longitudinally between two stop elements. The sleeve valve 84 includes a left side seal 86, and a rod seal 88 is mounted to a rod retainer 90 at an end portion 92 of the rod 50. The wide passageway 58 in the divider wall 54 includes a check valve 94; the narrow passageway 60 in the divider wall is controlled by the sleeve valve 84 which includes a passageway 95 to align or misalign with the passageway 60 depending on whether the sleeve valve is positioned by a left stop 96 or a right stop 98.

Figure 6:
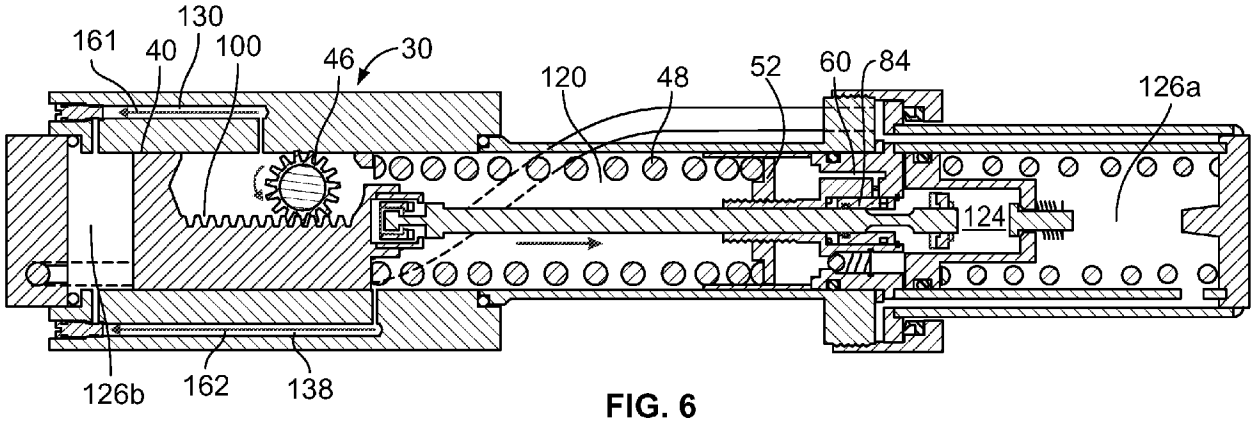
FIG. 6 is a sectional plan view like that shown in FIG. 4, with a main piston and rod moving to the right to compress a main spring.
Figure 7:
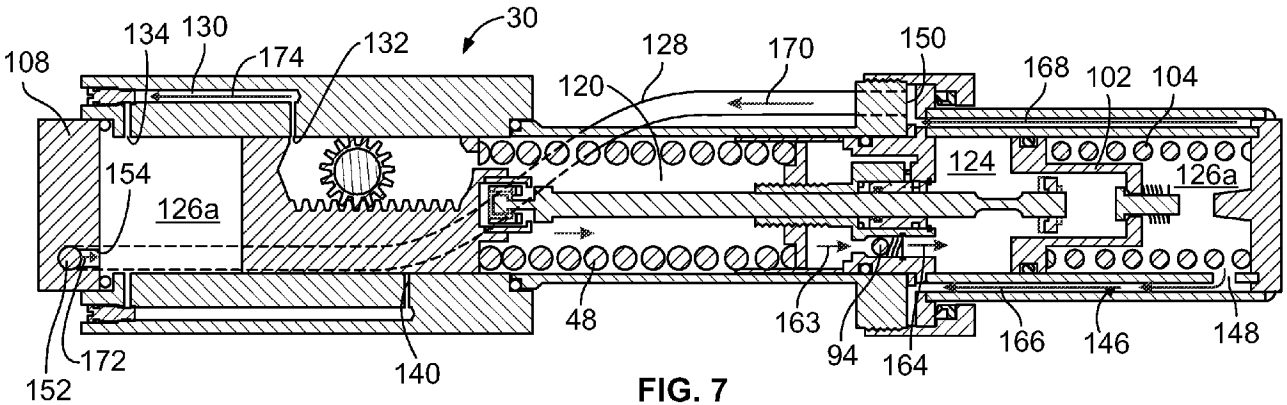
FIG. 7 is a sectional plan view like that shown in FIG. 6, but with the main piston and the rod moving further to the right and a supplemental piston beginning to compress a supplemental spring.
Figure 8:
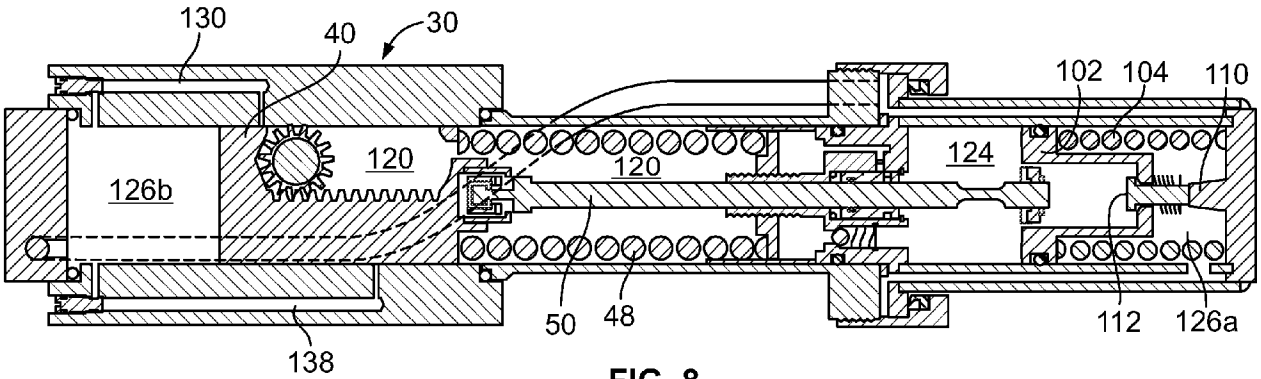
FIG. 8 is a sectional plan view like that shown in FIG. 7, but with the main spring and the supplemental spring reaching full compression.

The spindle 44 with the mounted pinion 46 engages a rack 100 formed in the main piston 40 such that rotation of the spindle by the arm 16 when the door is opened causes the pinion 46 to rotate and move the main piston 40 toward the middle section 34 of the housing. Moving the main piston to the right progressively compresses the main spring 48, as illustrated in FIGS. 6-8. Mounted in the third section 36 of the housing are a movable cup-shaped second or supplemental piston 102 and a compressible second or supplemental spring 104. The housing is plugged by an end cap 106 at a right end and by an end cap 108 at the left end. The end cap 106 includes an internal boss 110. A relief valve 112 is mounted in a base 114 of the supplemental piston 102 and is configured to engage the boss as shown in FIG. 8. A first hydraulic fluid chamber 120 is formed around the main spring, and through a port 122, around the rack 100 and the pinion 46. A second hydraulic fluid chamber 124 is formed within the cup-shaped supplemental piston 102 and to the right of the divider wall 54 as the supplemental piston moves away from the divider wall. A first portion 126*a* of a third hydraulic fluid chamber 126 is formed in the third section 36. A second portion 126*b* of the third chamber 126 is located between the main piston 40 and the housing end cap 108. A transfer tube 128 communicates the two portions 126*a*, 126*b* of the third chamber 126 to maintain equal pressure.

A plurality of passageways and ports are incorporated in the housing 30 to enable hydraulic fluid communication between the three fluid chambers 120, 124, 126, where the chamber 126 is divided into two portions 126*a* and 126*b*. A hydraulic fluid conduit 130, FIG. 4, has a first port 132 in the first chamber 120 and a second port 134 in the third chamber portion 126*b*, and includes a sweep speed adjustment screw 136. Another hydraulic conduit 138 has a first port 140 in the first chamber 120, initially unblocked by the main piston 40, and a second port 142 in the third chamber portion 126*b* and includes a latch speed adjustment screw 144. A tubular passageway 146 is formed in the third section 36 of the housing with a first port 148 in the third chamber portion 126*a* and a second port 150 at one end of the transfer tube 128 to accommodate communication with the chamber portion 126*b* through ports 152, 154 in the right end cap 108. There is also the narrow passageway 60 in the divider wall 54, a port 160 in the divider wall, and another port 162 selectively blocked by the sleeve valve 84. The sweep speed adjustment screw 136 controls door speed from full open down to about 10° from full closed. The latch speed adjustment screw 144 allows variability to the door closing speed from about 10° open down to fully closed.

Figure 10:
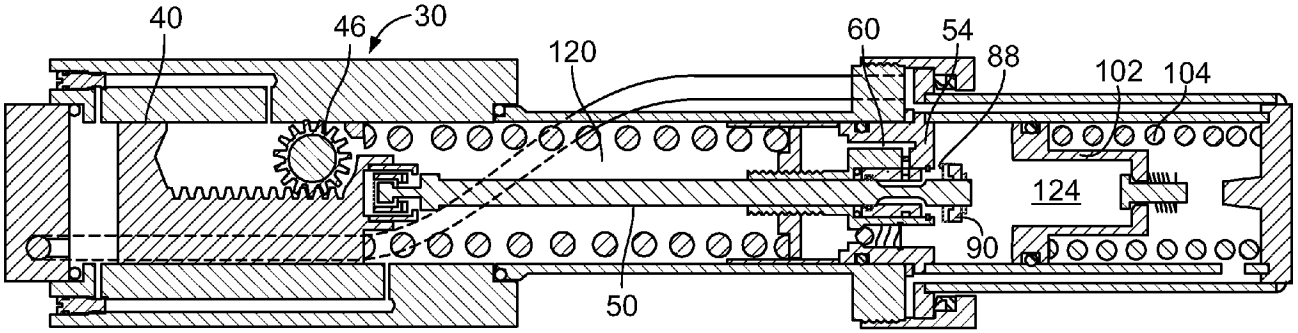
FIG. 10 is a sectional plan view like that shown in FIG. 9, with the main piston moving toward its left position, the main spring moving toward full extension and the supplemental spring providing door closing boost.

Referring to FIG. 4, the door closer's internal elements are shown at-rest when the door is in a closed position and before prior door openings load the supplemental spring. Therefore, both the main spring 48 and the supplementary spring 104 are in their extended positions. It is noted that the main spring is lightly preloaded. The supplemental spring is significantly preloaded so that its minimum force at closure equals the desired boosting force. Stored energy in the supplemental spring is illustrated in FIG. 10, where the door is almost closed and the door closure is almost at-rest. In operation, when the door is opened, the main arm 16, FIGS. 1-3, pivots causing rotation of the spindle 44. Rotation of the spindle causes the pinion 46 to rotate counterclockwise as illustrated in FIG. 6. The rotating pinion drives the main piston 40 and the connected rod 50 to the left by way of the rack 100 toward the spring seat 52 resulting in compression of the main spring 48. Movement of the rod to the left moves the sleeve valve 84 to the left from the left stop 96 toward the right stop 98 because of friction between the two elements. The movement of the sleeve valve 84 closes the passageway 60 to block hydraulic fluid in the first chamber 120 from flowing to the second chamber 124. Therefore, the supplemental piston 102 and the supplemental spring 104 do not move initially.

Fluid moves from the chamber 120 into the chamber portion 126*b* by way of the passageways 130 and 138 as shown by arrows 161, 162. As illustrated in FIG. 7, as the door is opened more fully or more forcefully, movement of the main piston 40 to the left blocks the port 140, continues to compress the main spring 48, and causes fluid to open the check valve 94. Fluid at a higher pressure from the chamber 120 is able to move into the second chamber 124 as depicted by arrows 163, 164 and causes the supplemental piston 102 to begin compression of the supplemental spring 104 resulting in the storage of energy in the supplemental spring. The rod continues to move rightward because the main piston continues to move rightward. Fluid from third chamber portion 126*a* is able to pass through the port 148 into the tubular passageway 146 and through the port 150 into the transfer tube 128. Fluid from the transfer tube 128 continues to pass through the ports 152, 154 in the left end cap 108 into the third chamber portion 126*b*, all as depicted by arrows 166, 168, 170, 172. Fluid also flows from the chamber 120 into the chamber portion 126*b* by way of the port 132, the passageway 130 and the port 134 as depicted by an arrow 174.

Referring to FIG. 8, the door closure elements in the housing 30 are illustrated when the door is fully open at the end of travel for the main piston 40 and both the main spring 48 and the supplemental spring 104 are fully compressed, a condition that may take several opening cycles to achieve. Any further attempt at compression will cause the relief valve 112 to engage the boss 110. Engagement of the relief valve 112 and the boss 110 relieves pressure in the second chamber 124 sufficiently enough to have the supplemental piston 102 move away from the boss 110 (toward the left in FIG. 8) to avoid excessive compression of the supplemental spring 104. Meanwhile, the passageway 138 remains blocked by the main piston 40.

Figure 9:
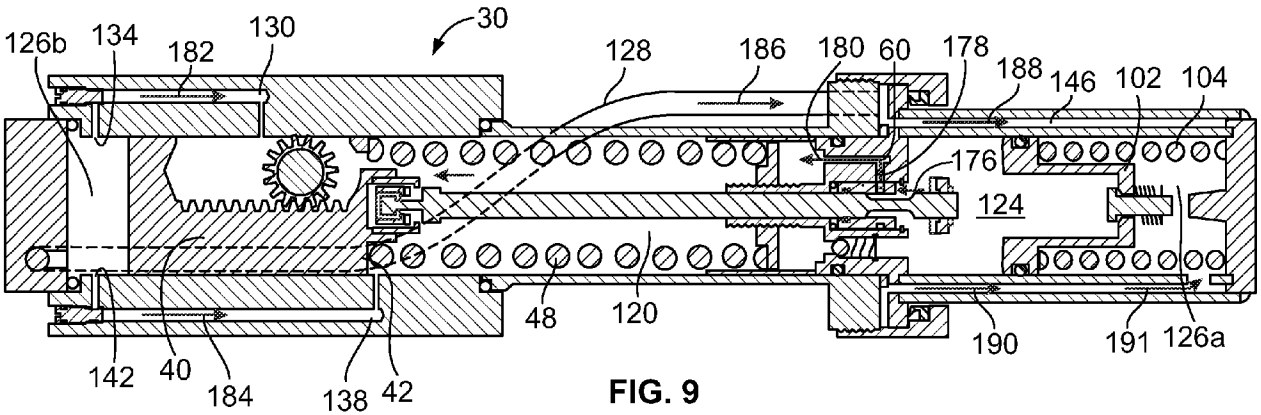
FIG. 9 is a sectional plan view like that shown in FIG. 8, with the main piston and rod moving to the left causing the door to close under the influence of an expanding main spring.

When the door opening force is removed, the main spring 48 returns the main piston 40 toward the end cap 108 as illustrated in FIG. 9. During travel of the main piston 40 and the connected rod 50, the sleeve valve 84 is moved to the left from the right stop 98 to the left stop 96 to enable fluid to pass from the second chamber 124 to the first chamber 120 as indicted by arrows 176, 178, 180 through the narrow passageway 60, thereby providing a closing boost to the door from the supplemental spring 104 by increasing pressure on the main piston right surface 42. Meanwhile, fluid leaves the chamber portion 126*b* through the ports 134, 142 into the chamber 120 as depicted by arrows 182, 184 and flows through the passageways 130, 138, and from the third chamber portion 126*b* into the third chamber portion 126*a* through the transfer tube 128 and the tubular passageway 146 as depicted by arrows 186, 188, 190, 191. As the door moves toward full closure the seal 88 of the retainer 90 almost abuts the divider wall 54 to stop fluid flow through the narrow passageway 60 from the chamber 124 to the chamber 120 as shown in FIG. 10. When the retainer seal blocks flow from the second chamber 124 to the first chamber 120 the boost action of the supplemental spring 104 ceases even though the supplemental spring may still be compressed to provide additional future closing boosts.

Another embodiment of the present invention is illustrated in FIGS. 11-15. The embodiment is in the form of internal elements of a door closure apparatus 200, that is, minus the outer casing 12, the arms 16, 18, and other outer elements already described in detail above in relation to FIGS. 1-3. The door closure includes a cylindrical housing 202, a first or main piston 204 movable in the housing 202, a first or main spring 206 mounted between a main piston end surface 208 and a right side end wall 210 of the housing 202, a rod 212 attached at one end 214 to an opposite main piston end surface 216, a retainer 218 mounted to the rod 212 at another rod end 220, a spindle 222 connected to the arm 16, a pinion 224 mounted around the spindle 222 and engaged with a rack 226 formed in the main piston 204, a second or supplemental piston 228 to slide along the rod 212, and a second or supplemental spring 230 mounted between one end 232 of the supplemental piston 228 and the retainer 218. The housing 202 is divided generally into three hydraulic fluid chambers, a first or right chamber 240 formed between the main piston end surface 208 and the housing right end wall 210, a second or center chamber 242 formed between the main piston 204 and the supplemental piston 228, and a third or left chamber 244 formed between the supplemental piston and a housing left end wall 246.

Communicating between the first chamber 240 and the second chamber 242 is a passageway 250 having a port 252 in the first chamber 240 and a port 254 in the second chamber 242 and including a sweep speed adjustment screw 256 and a boost speed adjustment screw 258. The port 254 is selectively blocked and unblocked by the supplemental piston 228. Another passageway 260 communicates the first chamber 240 and the third chamber 244 with a port 262 in the first chamber 240 and a port 264 in the third chamber 244 and includes a latch speed adjustment screw 266. The port 262 is selectively blocked and unblocked by the main piston 204. The port 264 is blocked and unblocked by the supplemental piston 228. Yet another passageway 268 is formed in the main piston 204 communicating between the first chamber 240 and the second chamber 242 and including a check valve 270 allowing fluid to pass from the first chamber 240 to the second chamber 242, but not in the opposite direction. The main piston 204 includes a seal 272 between the main piston and the housing, and the supplemental piston 228 includes a seal 274 between the supplemental piston and the housing.

Figure 11:
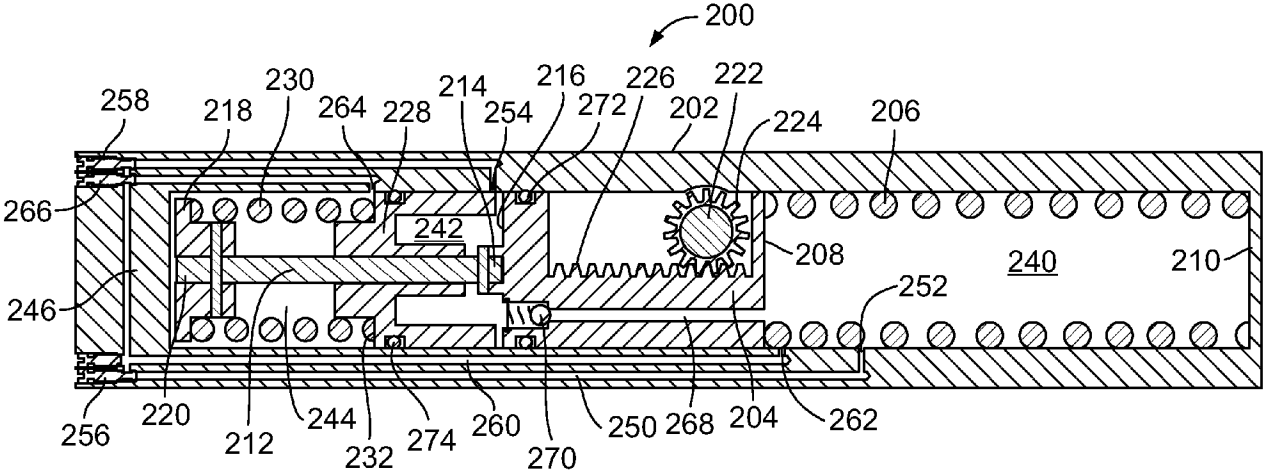
FIG. 11 is a sectional plan view of another embodiment of the hydraulic door closure apparatus taken along line 4-4 in FIG. 2, and illustrating the door closure apparatus illustrated at rest.
Figure 12:
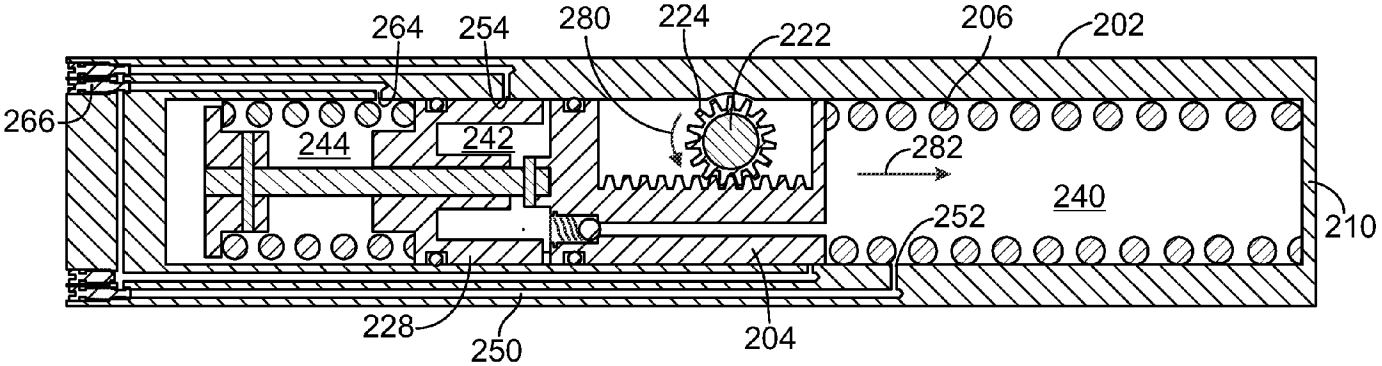
FIG. 12 is a sectional plan view like that shown in FIG. 11, with a main piston and rod moving to the right to compress a main spring.

In operation, the door closure apparatus 200 shown in FIG. 11, illustrates the various elements within the housing 202 at rest with the door to which the door closure apparatus is attached in a closed position with no compression yet of the supplemental spring 230. When the door is opened as depicted in FIG. 12, the spindle 222 and pinion 224 rotate counterclockwise as represented by an arrow 280 to move the main piston 204 toward the right housing end wall 210 as represented by an arrow 282. Fluid in the first chamber 240 is pushed through the port 252 into the passageway 250, passed the speed adjustment screw 266, and through the port 264 to fill the third chamber 244. The volume of the second chamber 242, between the main and supplemental pistons 204, 228, remains constant initially because the supplemental piston 228 seals the port 254 during the rightward movement of the main piston 204. Rightward movement of the main piston compresses the main spring 206 to store energy for an initial closure once the door opening force is removed.

Figure 13:
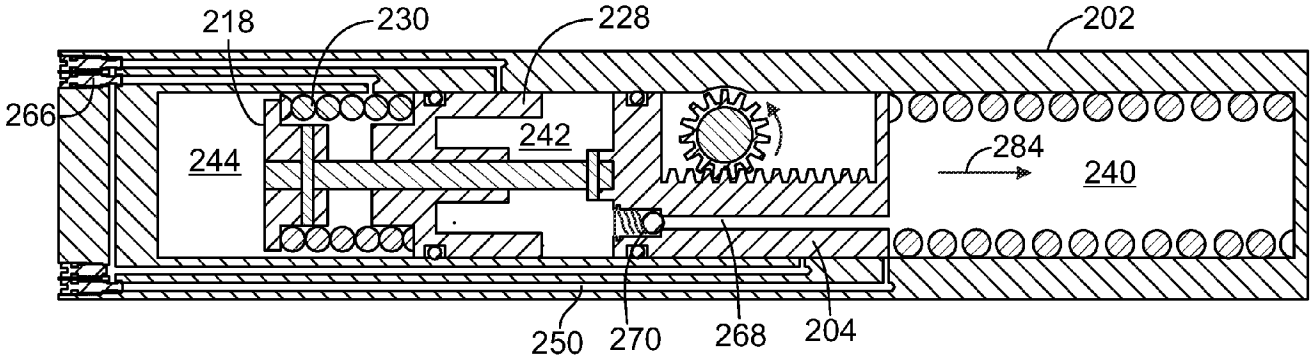
FIG. 13 is a sectional plan view like that shown in FIG. 12, but with the main piston and the rod moving further to the right and a supplemental piston beginning to compress a supplemental spring.

When the door is opened further or with a greater force the main piston 204, FIG. 13, moves toward the right end wall with greater speed as indicated by an arrow 284. The restriction of the latch speed adjustment screw 266 prevents sufficient fluid from flowing out of the first chamber 240 through the passageway 250 and into the third chamber 244. The restriction causes pressure in the first chamber 240 to increase sufficiently to overcome the supplemental spring 230 and fluid flows through the passageway 268, past the check valve 270, and into the second chamber 242. The added fluid in the second chamber 242 slows the rightward movement of the supplemental piston 228 as compared to the main piston 204, increasing the volume of the second chamber 242, and compressing the supplemental spring 230 positioned between the supplemental piston and the retainer 218 moving rightward at the same speed as the main piston 204.

Figure 14:
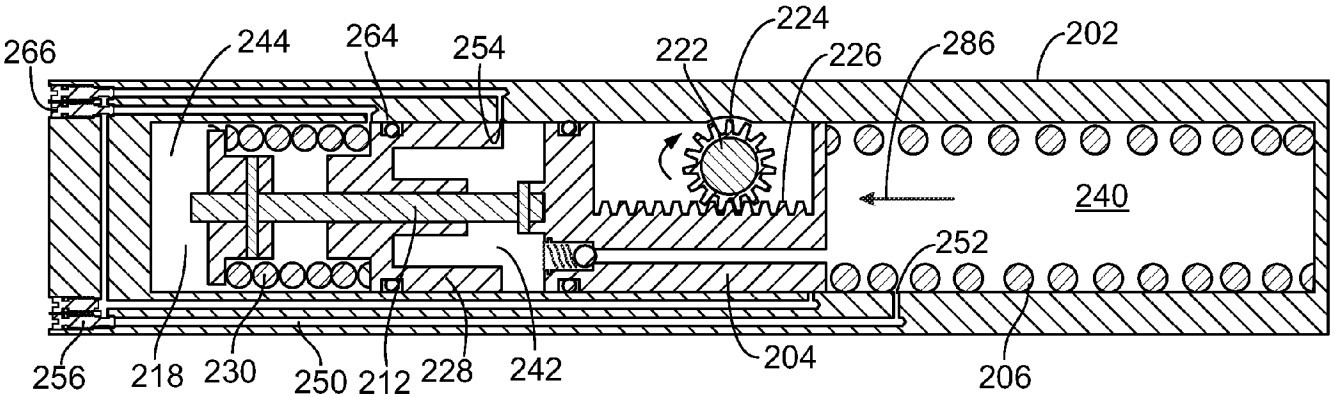
FIG. 14 is a sectional plan view like that shown in FIG. 13, with the main piston and rod moving to the left causing the door to close under the influence of an expanding main spring.

When the door opening force is released, the main spring 206 provides the initial closing force by way of the main piston 204 and the rack 226 on the pinion 224 and the spindle 222, and from the spindle on the arms 16, 18. The main piston 204 moves leftward as indicated by an arrow 286. Fluid flow reverses from that described in relation to FIG. 13. The port 254 remains sealed by the supplemental piston 228 as shown in FIG. 14. Hence, fluid flows from the third chamber 244 through the port 264, the passageway 250 and the port 252 to the first chamber 240. On the other hand, fluid is trapped in the second chamber 242 so that the supplemental piston 228 moves in unison with the main piston and the stored energy in the compressed supplemental spring 230 is maintained. The closing speed of the door is regulated by the speed adjustment screw 266 and the sweep speed adjustment screw 256.

Figure 15:
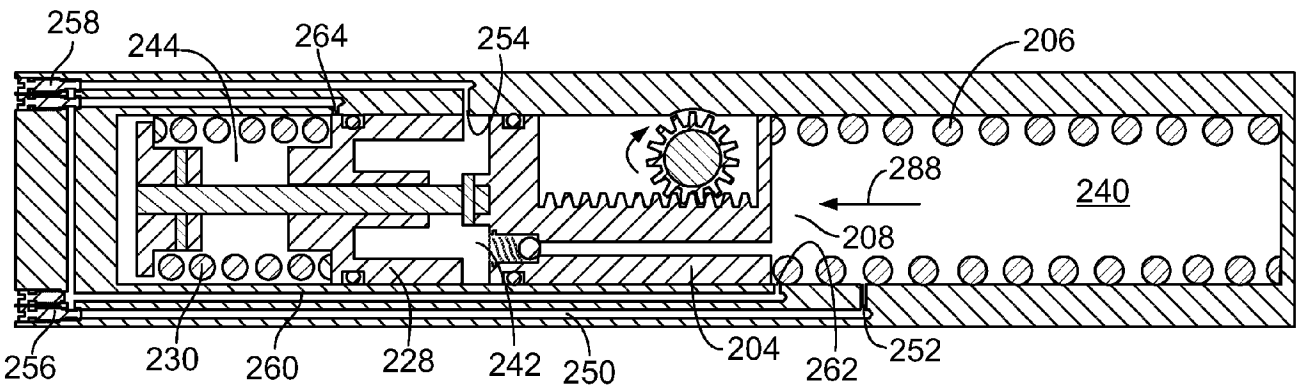
FIG. 15 is a sectional plan view like that shown in FIG. 14, with the main piston moving toward its most leftward position, the main spring moving toward full extension and the supplemental spring providing door closing boost.

As illustrated in FIG. 15, further leftward movement of the main piston 204 as indicated by an arrow 288 unblocks the second chamber port 254 allowing a boost from the supplemental spring 230. The same movement causes the third chamber port 264 to become blocked by the supplemental piston 228 immobilizing the supplemental piston. This allows fluid to flow from the second chamber 242 through the port 254, through the passageway 250 and into the first chamber 240 through the port 252 so as to boost pressure on the right surface 208 of the main piston 204 that is also being driven by the extending main spring 206. These changes allow the supplemental spring to extend, exerting force on the locked supplemental piston and the rod connected to the main piston helping to move the main piston to the closed position. The boost speed adjustment screw 258 and the sweep speed adjustment screw 256 control the speed of door closing in boost. As the door nears full closure, the main piston unblocks an additional port, the port 262, which bypasses the sweep speed adjustment screw 256 by using the passageway 260 and provides additional pressure to the main piston to ensure proper latching of the door.

As the supplemental spring 230 extends and returns its energy to the main piston, the rod 212 moves through the supplemental piston 228 into the third chamber 244 to increase the volume of the third chamber 244. Increasing volume in the third chamber moves the supplemental piston 228 slightly to keep the third chamber port 264 partially open. When the main piston stops, the slight openness between the third chamber port 264 and the second chamber port 254 permits fluid to flow between the second chamber 242 and the third chamber 244 allowing the supplemental piston to move back to its at-rest position where the third chamber port 264 is fully open and the second chamber port 254 is fully blocked.

In the alternative, the embodiment illustrated in FIGS. 11-15, may use the valves disclosed for the embodiment illustrated in FIGS. 4-10, even though the main and supplemental pistons are located differently. The valve and piston locations of the two embodiments disclosed in detail above may be mixed and matched. It is noted that the embodiment shown in FIGS. 11-15, illustrates a simple and less expensive configuration whereas the embodiment shown in FIGS. 4-10, makes the fewest performance compromises but at a higher manufacturing cost. It is also noted that length and location of the arms 16, 18, FIGS. 1-3, may vary as a function of the embodiment employed, as may the size and/or spring rate of the springs used.

Figure 16:
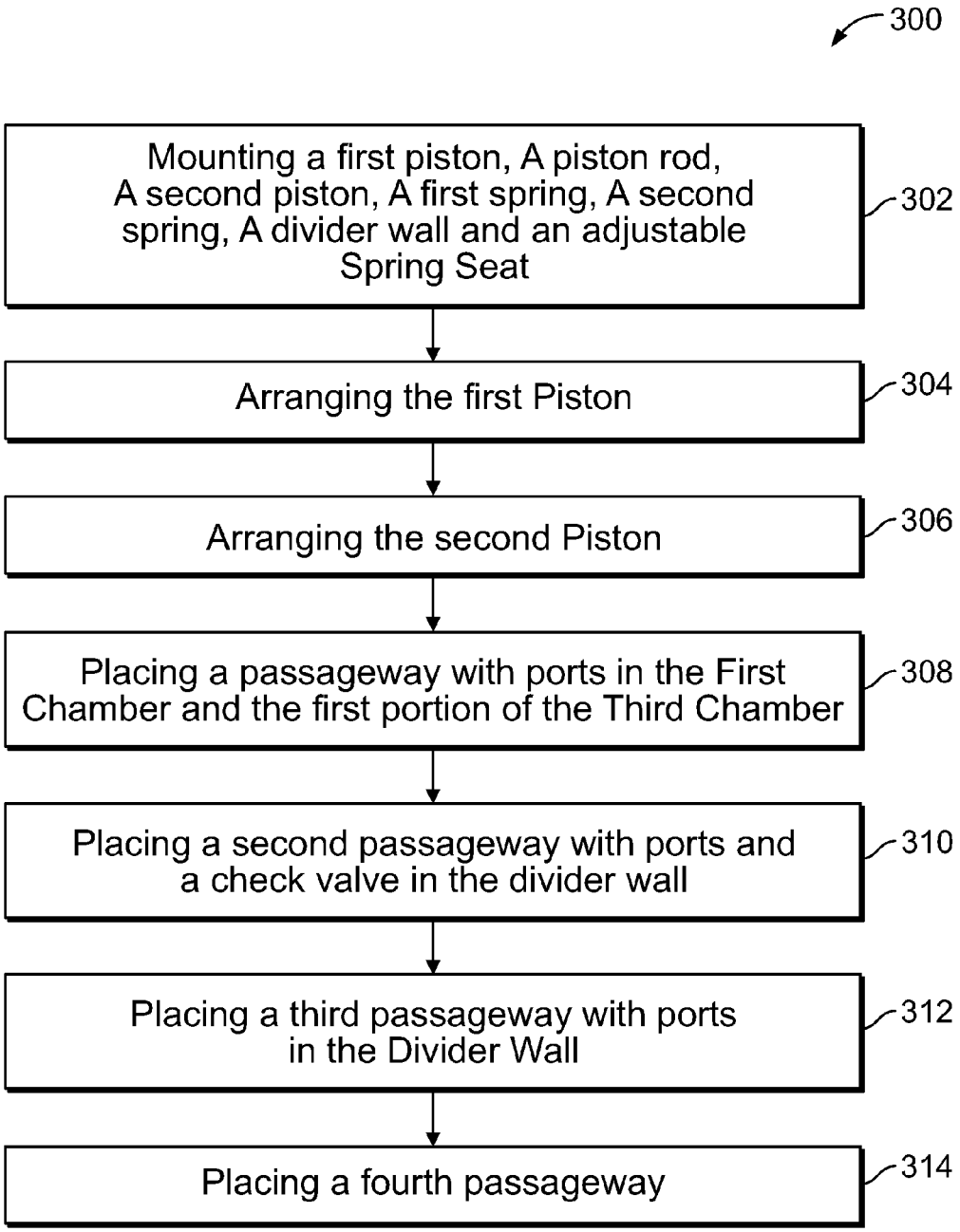
FIG. 16 is a flow diagram of a method for making the inventive hydraulic door closure apparatus.

The present invention also includes a method 300, FIG. 16, for making the door closure apparatus having a closing boost, the steps of the method including mounting a first piston, a piston rod, a second piston, a first spring, a second spring, a divider wall and an adjustable spring seat 302 in an elongated housing having first, second and third chambers for hydraulic fluid, (another embodiment may dispense with the divider wall and the spring seat), arranging the first piston to operatively engage a rotatable pinion 304 and to compress the first spring and selectively compress the second spring when a door to which the door closure apparatus is attached is opened, the first piston located between the first chamber and a first portion of the third chamber, arranging the second piston to compress the second spring 306, the second piston located between the divider wall and an end of the housing in a second portion of the third chamber, placing a passageway with ports in the first chamber and the first portion of the third chamber 308 such that fluid is enabled to move from the first chamber to the first portion of the third fluid chamber when the first piston is operatively engaged by the pinion, placing a second passageway with ports and a check valve in the divider wall 310 to enable fluid to move from the first chamber to the second chamber to move the second piston and compress the second spring, placing a third passageway with ports in the divider wall 312 to communicate the first chamber with the second chamber, and placing the fourth passageway with ports in the first chamber and the first portion of the second chamber 314 to enable fluid to move from the first portion of the third chamber to the first chamber.

From the foregoing, it can be seen that there has been provided features and disclosure for an improved door closure apparatus with boost and a disclosure for the method of the making the door closure apparatus. While particular embodiments of the present invention have been shown and described in detail, it will be obvious to those skilled in the art that changes and modifications may be made without departing from the invention in its broader aspects. Therefore, the aim here is to cover all such changes and modifications as fall within the true spirit and scope of the invention. The matters set forth in the foregoing description and accompanying drawings are offered by way of illustrations only and not as limitations. The actual scope of the invention is defined by the subsequent claims when viewed in their proper perspective based on prior art.

What is claimed is:

1. A door closure for providing a closing boost comprising:

an elongated housing mounted to a door, the housing having first and second opposite ends and being divided generally into first, second and third fluid chambers:

a first piston movably mounted in the housing to move fluid between the first and third fluid chambers, the first piston including a rack engaging a pinion to move the first piston is response to the door opening and to enable the door to close;

a piston rod and retainer connected to the first piston and movable therewith;

a second, cup shaped piston movably mounted in the housing and forming the second fluid chamber;

a first spring mounted in the first fluid chamber of the housing and operatively connected to the first piston;

a second spring mounted in the third fluid chamber of the housing operatively connected to the second piston;

a first fluid passageway between the first fluid chamber and the third fluid chamber;

a second fluid passageway between the first fluid chamber and the second fluid chamber and including a check valve;

a third fluid passageway between the first and third fluid chambers; and a fourth fluid passageway between the first and second fluid chambers; and wherein upon the door opening, fluid is transferred from the first fluid chamber to the third fluid chamber through the first fluid passageway, and initially through the third fluid passageway, and the first spring is compressed, and concluding with fluid selectively transferring through the second fluid passageway from the first fluid chamber to the second fluid chamber to move the second piston and compress the second spring; and upon the door closing, the first spring extends against the first piston, fluid is transferred from the third fluid chamber to the first fluid chamber through the first fluid passageway and the third fluid passageway, and fluid is selectively transferred from the second fluid chamber to the first fluid chamber through the fourth fluid passageway to boost closing of the door.

2. The door closure of claim 1, including:

a divider wall between the first fluid chamber and the second fluid chamber, the divider wall including the second fluid passageway and the fourth fluid passageway.

3. The door closure of claim 2, including:

a longitudinally adjustable spring seat in the first fluid chamber for the first spring.

4. The door closure of claim 3, including:

a sleeve valve for blocking and unblocking the fourth fluid passageway.

5. The door closure of claim 4, including:

a door sweep adjustment screw located in the first fluid passageway; and a latch adjustment screw located in the third fluid passageway.

6. The door closure of claim 1, including:

a sleeve valve for blocking and unblocking the fourth fluid passageway.

7. The door closure of claim 1, including:

a longitudinally adjustable spring seat in the first fluid chamber for the first spring.

8. The door closure of claim 1, including:

a door sweep adjustment screw located in the first fluid passageway.

9. The door closure of claim 1, including:

a latch adjustment screw located in the third fluid passageway.

10. The door closure of claim 1, wherein:

the second piston is mounted to slide with the piston rod.

11. The door closure of claim 10, wherein:

the first spring is mounted in the first fluid chamber between the first piston and an adjustable spring seat; and the second spring is mounted between the second piston and the first end of the housing.

12. The door closure of claim 1, wherein:

the first spring is mounted in the first fluid chamber between the first piston and an adjustable spring seat.

13. The door closure of claim 1, wherein:

the second spring is mounted between the second piston and the first end of the housing.

14. The door closure of claim 1, wherein:

a sweep adjustment screw is located in the first fluid passageway; and a latch adjustment screw is located in the fourth fluid passageway.

15. A door closure for providing a closing boost comprising:

an elongated housing mounted to a door, the housing having first and second opposite ends and being divided into first, second and third fluid chambers, the third fluid chamber having first and second portions:

a first piston movably mounted in the housing between the first chamber and the first portion of the third chamber, the first piston including a rack engaging a pinion to move the first piston is response to the door opening;

a piston rod and retainer connected to the first piston and movable therewith;

a divider wall mounted in the housing between the first and second fluid chambers;

a second, cup shaped piston movably mounted in the housing between the divider wall and the first end of the housing;

a spring seat adjustably mounted to the housing in the first chamber;

a first spring mounted in the first fluid chamber of the housing between the first piston and the spring seat;

a second spring mounted in the second portion of the third fluid chamber of the housing between the second piston and the first end of the housing;

a first fluid passageway communicating between the first fluid chamber and the first portion of the third fluid chamber;

a second fluid passageway including a check valve located in the divider wall and communicating between the first fluid chamber and the second fluid chamber;

a third fluid passageway communicating between the first fluid chamber and the first portion of the third fluid chamber; and a fourth fluid passageway located in the divider wall communicating between the first and second fluid chambers.

16. The door closure of claim 15, including:

a sleeve valve for blocking and unblocking the fourth fluid passageway.

17. The door closure of claim 16, including:

a door sweep adjustment screw located in the first fluid passageway; and a latch adjustment screw located in the third fluid passageway.

18. A method of making a door closure having a closing boost, the steps of the method comprising:

mounting a first piston, a piston rod, a second piston, a first spring, a second spring, a divider wall and an adjustable spring seat in an elongated housing having first, second and third fluid chambers for hydraulic fluid;

arranging the first piston having a rack to operatively engage a rotatable pinion and to compress the first spring and selectively compress the second spring when a door to which the door closure is attached is opened, the first piston located between the first fluid chamber and a first portion of the third fluid chamber;

arranging the second piston to compress the second spring, the second piston located between the divider wall and an end of the housing in a second portion of the third fluid chamber;

placing a passageway with ports in the first fluid chamber and the first portion of the third fluid chamber such that fluid is enabled to move from the first fluid chamber to the first portion of the third fluid chamber when the first piston is operatively engaged by the pinion;

placing a second passageway with ports and a check valve in the divider wall to enable fluid to move from the first fluid chamber to the second fluid chamber to move the second piston and compress the second spring;

placing a third passageway with ports in the divider wall and communicating the first fluid chamber with the second fluid chamber; and placing a fourth passageway with ports in the first fluid chamber and a first portion of the second fluid chamber to enable fluid to move from the first portion of the third fluid chamber to the first fluid chamber.

19. The method of claim 18 including the step of:

mounting a sleeve valve on the piston rod adjacent a reduced diameter portion of the rod.

20. The method of claim 19 including the step of:

making a portion of the housing rotatable relative to another portion of the housing for adjusting the spring seat.

* * * * *